US007566014B2

(12) United States Patent
Koslow et al.

(10) Patent No.: US 7,566,014 B2
(45) Date of Patent: Jul. 28, 2009

(54) PROCESS FOR PRODUCING FIBRILLATED FIBERS

(75) Inventors: Evan E Koslow, Fairfield, CT (US); Anil C Suthar, West Windsor, NJ (US)

(73) Assignee: KX Technologies LLC, Orange, CT (US)

( * ) Notice: Subject to any disclaimer, the term of this patent is extended or adjusted under 35 U.S.C. 154(b) by 224 days.

(21) Appl. No.: 11/694,070

(22) Filed: Mar. 30, 2007

(65) Prior Publication Data

US 2008/0054107 A1 Mar. 6, 2008

Related U.S. Application Data

(60) Provisional application No. 60/842,195, filed on Aug. 31, 2006.

(51) Int. Cl.
*B02C 19/00* (2006.01)

(52) U.S. Cl. ..... 241/21; 241/29

(58) Field of Classification Search ..... 241/21, 241/29; 162/20, 55, 157.6, 161, 181.1, 181.2, 162/181.4, 181.6, 181.8
See application file for complete search history.

(56) References Cited

U.S. PATENT DOCUMENTS

| | | | |
|---|---|---|---|
| 2,810,646 | A | 10/1957 | Wooding et al. |
| 4,166,584 | A | 9/1979 | Asplund |
| 4,459,332 | A | 7/1984 | Giglia |
| 4,495,030 | A | 1/1985 | Giglia |
| 4,565,727 | A | 1/1986 | Giglia et al. |
| 4,761,203 | A | 8/1988 | Vinson |
| 4,811,908 | A | 3/1989 | Galati |
| 4,828,698 | A | 5/1989 | Jewell et al. |
| 4,904,343 | A | 2/1990 | Giglia et al. |
| 4,929,502 | A | 5/1990 | Giglia |
| 5,019,311 | A | 5/1991 | Koslow |
| 5,084,136 | A | 1/1992 | Haines et al. |
| 5,180,630 | A | 1/1993 | Giglia |
| 6,660,172 | B2 | 12/2003 | Koslow |
| 6,835,311 | B2 | 12/2004 | Koslow |
| 6,866,704 | B2 | 3/2005 | Koslow |
| 6,872,311 | B2 | 3/2005 | Koslow |

(Continued)

OTHER PUBLICATIONS

Fang Qiao, Kalman Migler, Donald Hunston, Charles Han, Reactive Compatibilization and In-line Morphological Analysis of Blends of PET and a Thermotropic Liquid Crystalline Polymer, Polymer Engineering and Science, Jan. 2001, vol. 41, No. 1.

*Primary Examiner*—Mark Rosenbaum
(74) *Attorney, Agent, or Firm*—DeLio & Peterson, LLC; Peter W. Peterson

(57) ABSTRACT

A process for making fibrillated fibers includes preparing a fluid suspension of fibers, low shear refining the fibers at a first shear rate to create fibrillated fibers having a reduced CSF, and subsequently higher shear refining the fibers at a second shear rate, higher than the first shear rate, to increase the degree of fibrillation of the fibers. The refining at the first shear rate may be with a rotor at a first maximum shear rate and the refining at the second shear rate may be with a rotor at a second maximum shear rate, higher than the first maximum shear rate. The process may further include pre-treating the fibers by high shear refining with impact to stress the fibers prior to low shear refining.

22 Claims, 3 Drawing Sheets

U.S. PATENT DOCUMENTS

2001/0020306 A1 9/2001 Leibnitz et al.
2004/0178142 A1 9/2004 Koslow
2005/0051487 A1 3/2005 Koslow
2005/0284595 A1 12/2005 Conley et al.
2006/0162879 A1 7/2006 Tinker

PROCESS FOR PRODUCING FIBRILLATED FIBERS

BACKGROUND OF THE INVENTION

1. Field of the Invention

This invention relates to the production of fibrillated fibers and, in particular, to production of fibrillated fibers by open channel refining.

2. Description of Related Art

The production of fibrillated fibers is known from, among others, U.S. Pat. Nos. 2,810,646; 4,495,030; 4,565,727; 4,904,343; 4,929,502 and 5,180,630. Methods used to make such fibrillated fibers have included the use of commercial papermaking machinery and commercial blenders. There is a need to efficiently mass-produce fibrillated fibers at lower cost for various applications, but such prior art methods and equipment have not proved effective for such purposes.

SUMMARY OF THE INVENTION

Bearing in mind the problems and deficiencies of the prior art, it is therefore an object of the present invention to provide an improved process and system for producing fibrillated fibers.

It is another object of the present invention to provide a process and system for producing fibrillated fibers that produces fibrils in the nanometer size range while retaining extended fiber length and avoiding production of fines.

A further object of the invention is to provide a process and system for producing fibrillated fibers that is more energy efficient and productive than prior methods, and results in improved volume and yield.

Still other objects and advantages of the invention will in part be obvious and will in part be apparent from the specification.

The above and other objects, which will be apparent to those skilled in art, are achieved in the present invention which is directed to a process for making fibrillated fibers comprising preparing a fluid suspension of fibers, low shear refining the fibers at a first shear rate to create fibrillated fibers having a reduced CSF, and subsequently higher shear refining the fibers at a second shear rate, higher than the first shear rate, to increase the degree of fibrillation of the fibers.

The refining at the first shear rate may be with a rotor at a first maximum shear rate and the refining at the second shear rate may be with a rotor at a second maximum shear rate, higher than the first maximum shear rate. The process may further include pre-treating the fibers by high shear refining with impact to stress the fibers prior to low shear refining. In such case, the fiber suspension may flow continuously and in series from the initial high shear refining to and through the subsequent low and higher shear refining The refining of the fibers may be performed with a first rotor operating at a first angular velocity and subsequently with a second rotor operating at a second angular velocity, higher than the first angular velocity, or with a first rotor having a first diameter and subsequently with a second rotor operating having second diameter, higher than the first diameter. The fiber suspension may flow continuously from the first rotor to the second rotor.

The process may include controlling the rate of flow of the fiber suspension, wherein reducing the flow rate extends the time the suspension is processed by each rotor and increases degree of fibrillation of the fibers, and increasing the flow rate reduces the time the suspension is processed by each rotor and decreases degree of fibrillation of the fibers. The process may also include removing from the fiber suspension heat generated by motion of the rotor during the open channel shearing.

The process may further include refining the fibers at a third shear rate, higher than the second shear rate, to further increase the degree of fibrillation of the fibers, or at more than three shear rates, with each shear rate being higher than the previous shear rate, to further increase the degree of fibrillation of the fibers.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
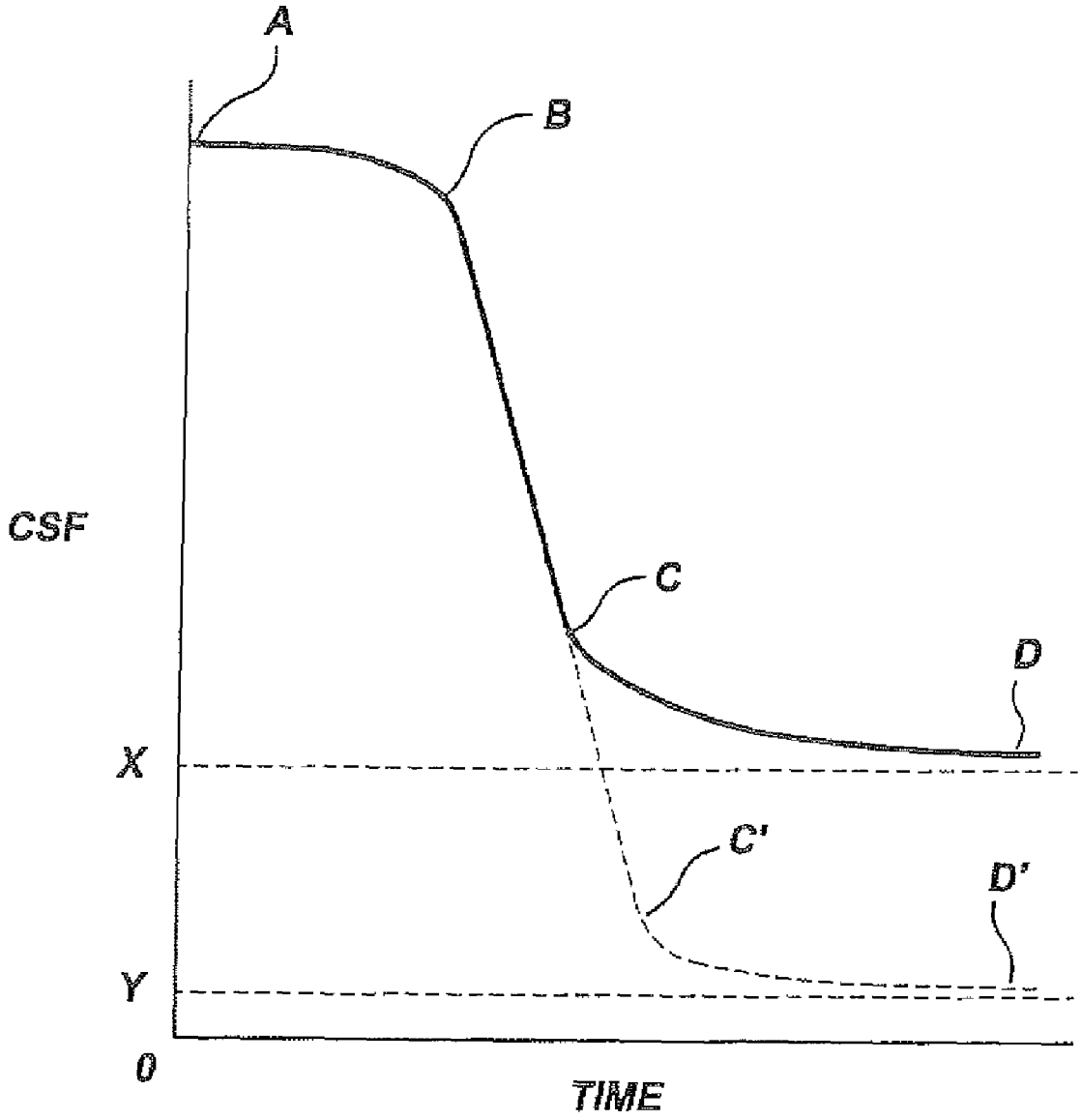
FIG. 1 is a graphical representation of the variation in the Canadian Standard Freeness (CSF) value of fibers as a function of time during shearing, as improved in accordance with the present invention.

In describing the preferred embodiment of the present invention, reference will be made herein to FIGS. 1-4 of the drawings in which like numerals refer to like features of the invention.

The present invention provides an efficient method of mass-producing fibrillated fiber cores with nanofiber fibrils for various applications by mechanical working of the fibers. The term "fiber" means a solid that is characterized by a high aspect ratio of length to diameter. For example, an aspect ratio having a length to an average diameter ratio of from greater than about 2 to about 1000 or more may be using in the generation of nanofibers according to the instant invention. The term "fibrillated fibers" refers to fibers bearing sliver-like fibrils distributed along the length of the fiber and having a length to width ratio of about 2 to about 100 and having a diameter of less than about 1000 nanometers. Fibrillated fibers extending from the fiber, often referred to as the "core fiber", have a diameter significantly less that the core fiber from which the fibrillated fibers extend. The fibrils extending from the core fiber preferably have diameters in the nanofiber range of less than about 1000 nanometers. As used herein, the term nanofiber means a fiber, whether extending from a core fiber or separated from a core fiber, having a diameter less than about 1000 nanometers. Nanofiber mixtures produced by the instant invention typically have diameters of about 50 nanometers up to less than about 1000 nanometers and lengths of about 0.1-6 millimeters. Nanofibers preferably have diameters of about 50-500 nanometers and lengths of about 0.1 to 6 millimeters.

It has been discovered that fibrillated fibers may be more efficiently produced by first open channel refining fibers at a first shear rate to create fibrillated fibers, and subsequently open channel refining the fibers at a second shear rate, higher than the first shear rate, to increase the degree of fibrillation of the fibers. As used herein, the term open channel refining refers to physical processing of the fiber, primarily by shearing, without substantial crushing, beating and cutting, that results in fibrillation of the fiber with limited reduction of fiber length or generation of fines. Substantial crushing, beating and cutting of the fibers is not desirable in the production of filtration structures, for example, because such forces result in rapid disintegration of the fibers, and in the production of low quality fibrillation with many fines, short fibers and flattened fibers that provide less efficient filtration structures when such fibers are incorporated into the paper filters. Open channel refining, also referred to as shearing, is typically performed by processing an aqueous fiber suspension using one or more widely spaced rotating conical or flat blades or plates. The action of a single moving surface, sufficiently far away from other surfaces, imparts primarily shearing forces on the fibers in an independent shear field. The shear rate varies from a low value near the hub or axis of rotation to a maximum shear value at the outer periphery of the blades or plates, where maximum relative tip velocity is achieved. However, such shear is very low compared to that imparted by common surface refining methods where two surfaces in close proximity are caused to aggressively shear fibers, as in beaters, conical and high speed rotor refiners, and disk refiners. An example of the latter employs a rotor with one or more rows of teeth that spins at high speed within a stator.

By contrast, the term closed channel refining refers to physical processing of the fiber by a combination of shearing, crushing, beating and cutting that results in both fibrillation of the fiber and reduction of fiber size and length, and a significant generation of fines compared to open channel refining. Closed channel refining is typically performed by processing an aqueous fiber suspension in a commercial beater or in a conical or flat plate refiner, the latter using closely spaced conical or flat blades or plates that rotate with respect to each other. This may be accomplished where one blade or plate is stationary and the other is rotating, or where two blades or plates are rotating at different angular speeds or in different directions. The action of both surfaces of the blades or plates imparts the shearing and other physical forces on the fibers, and each surface reinforces the shearing and cutting forces imparted by the other. As with open channel refining, the shear rate between the relatively rotating blades or plates varies from a tow value near the hub or axis of rotation to a maximum shear value at the outer periphery of the blades or plates, where maximum relative tip velocity is achieved.

In the preferred embodiment of the present invention, the fibrillated fibers and nanofibers are produced in continuously agitated refiners from materials such as cellulose, acrylic, polyolefin, polyester, nylon, aramid and liquid crystal polymer fibers, particularly polypropylene and polyethylene fibers. In general, the fibers employed in the present invention may be organic or inorganic materials including, but not limited to, polymers, engineered resins, ceramics, cellulose, rayon, glass, metal, activated alumina, carbon or activated carbon, silica, zeolites, or combinations thereof. Combination of organic and inorganic fibers and/or whiskers are contemplated and within the scope of the invention as for example, glass, ceramic, or metal fibers and polymeric fibers may be used together.

The quality of the fibrillated fibers produced by the present invention is measured in one important aspect by the Canadian Standard Freeness value. Canadian Standard Freeness (CSF) means a value for the freeness or drainage rate of pulp as measured by the rate that a suspension of pulp may be drained. This methodology is well known to one having skill in the paper making arts. While the CSF value is slightly responsive to fiber length, it is strongly responsive to the degree of fiber fibrillation. Thus, the CSF, which is a measure of how easily water may be removed from the pulp, is a suitable means of monitoring the degree of fiber fibrillation. If the surface area is very high, then very little water will be drained from the pulp in a given amount of time and the CSF value will become progressively lower as the fibers fibrillate more extensively.

The open channel refiners employed in the present invention can be staged in batch or continuous mode depending on the final product specifications. In batch mode, the fibers are sheared in a single vessel, and the rotor speed increases from a low shear rate to a high shear rate. In continuous mode, the fibers are sheared in a multiple vessels, and the rotor speed of each vessel through which the fibers are processed increases from a low shear rate to a high shear rate.

The reduction of CSF as a function of time for fibers during shearing at a constant rate is shown in FIG. 1. Initially, the fibers to be fibrillated have a high CSF value. During initial shearing, as depicted from point A to point B, the rate of fiber fibrillation and associated decrease in CSF is relatively low. Physically, it is believed that stress bands are being developed in the fiber core, without the fiber undergoing substantial fibrillation. After a time, as the fibers reach point B, the rate of fiber fibrillation increases, as shown by the more rapid rate of decrease in CSF between points B and C. After point C, the rate of CSF decrease and fibrillation diminishes and the curve begins to become asymptotic with the final achievable CSF value, X. Fibrillation continues at a lower rate until the process is stopped at a desired CSF value at point D.

It has been discovered that varying shear rate during the open channel refining of fibers results in more efficient fiber fibrillation. In order to shorten the time needed to reach point B on the CSF rate curve as shown in FIG. 1, the present invention optionally initially subjects the fibers to refining at a high shear rate to accelerate the formation of the stress bands in the fiber cores. Since fibrillation formation is minimal, the fibers may be impacted by a beating and/or cutting action, in addition to shearing. Once the fibers are sufficiently stressed and reach point B of the curve, shearing may be more efficiently performed at a lower shear rate (and lower unit energy consumption), by open channel refining, without substantial crushing, beating and cutting. Such shearing by open channel refining continues until the rate of decease in CSF begins to diminish (point C). At this time, in accordance with the present invention, the shear rate is increased over the value between points B and C, so that the rate of fibrillation and decrease in CSF value continues at a rapid pace, and the CSF value is drive down further to point C'. Optionally, the shear rate is further increased, until the desired CSF value Y is approached at point D', and the process is ended.

Figure 2:
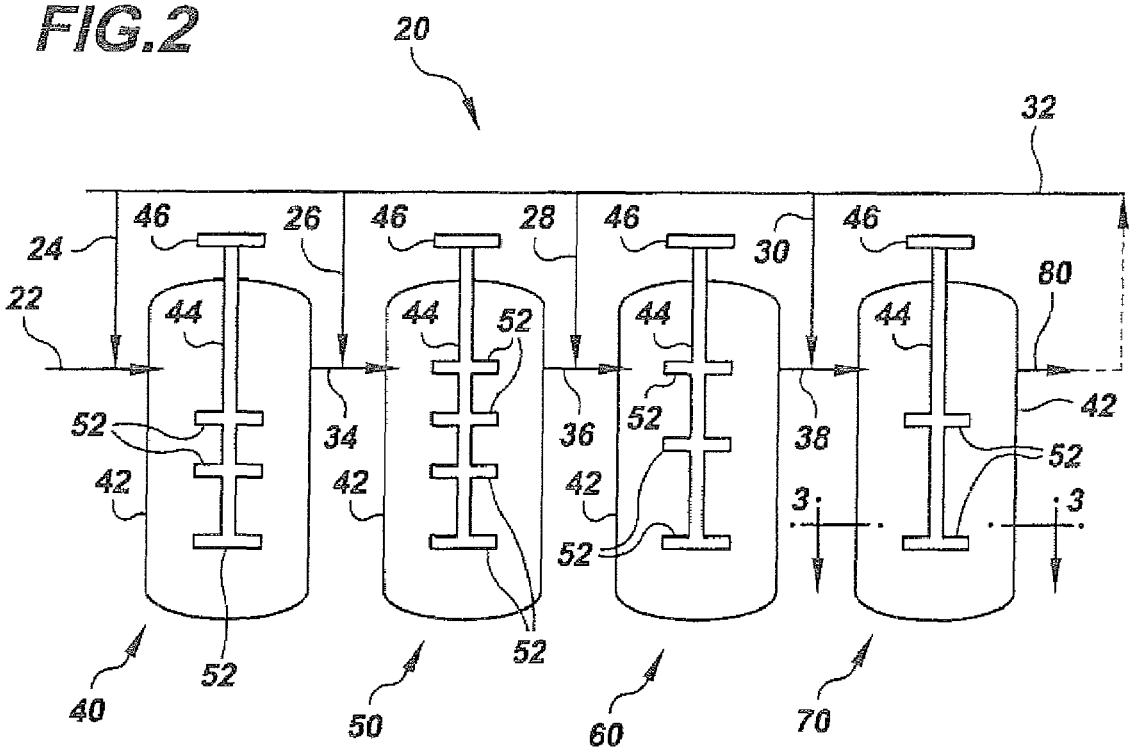
FIG. 2 is a side elevational view in cross section of the preferred system of open channel refiners used to produce fibrillated fibers in accordance with the present invention.

A preferred continuous arrangement of open channel refiners is depicted in FIG. 2, wherein four refiners 40, 50, 60 and 70 are shown in series. All of the refiners have jacketed and water cooled vessel housings 42 to absorb heat generated by the mechanical refining. Each has a motor 46 operatively attached to a central, vertical shaft 44 on which is mounted one or more spaced-apart, horizontally-extending blades, plates or rotors 52. The terms rotors shall be used interchangeably for blades or plates, unless otherwise specified. The number of rotors may vary in each refiner, normally depending on the position of the refiner in the process. As shown in FIG. 1, refiner 40 has three rotors of a first vertical spacing from each other and refiner 50 has four rotors of similar spacing. Refiner 60 is shown with three rotors of a larger vertical spacing, while refiner 70 has two rotors of approximately the same spacing. The rotors may vary in diameter, and preferably achieve a tip speed (i.e., speed at the outer diameter of rotor) of at least about 7000 ft./min. (2100 m/min). The rotors may contain teeth whose number may vary, preferably from 4 to 12.

Figure 3:
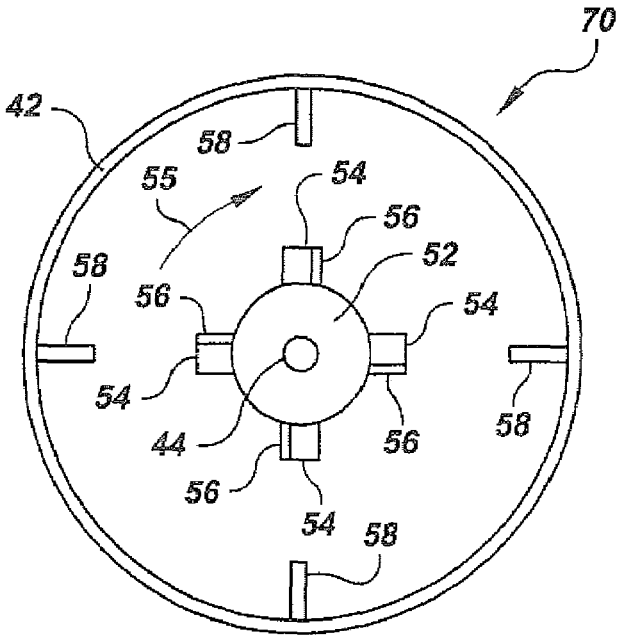
FIG. 3 is a top plan view, in partial cross-section, of a rotor in an open channel refiner of FIG. 2.

FIG. 3 shows a possible rotor configuration in one of the refiners 70, similar to that of a Daymax blender available from the Littleford Day Inc. of Florence, Ky. Rotor 52 is centrally mounted on shaft 44 and has extending radially therefrom a plurality of teeth 54, of which four are shown in this example. Rotor 52 rotates in direction 55, and sharpened edges 56 are provided on the leading edges of teeth 54. Baffles 58, partially radially inward extending from housing 42, help to impart turbulent mixing to the fiber suspension during the open channel refining.

In rotary processing equipment such as the refiners of FIG. 2, maximum shear rate at the outer periphery of the rotating blades or plates may be increased by changing the physical design of the rotor surface, by increasing the angular velocity of the rotor, or by increasing the diameter of the rotor. The rate of shear increases from a minimum to maximum as the tip velocity of the rotor increases. The first refiner 40 has the lowest shear rate of the refiners, and the last refiner 70 has the highest shear rate of the refiners. The refiners 50 and 60 have a moderate to high shear rate, respectively.

The process of making fibrillated fibers begins by feeding an aqueous suspension of fibers 22 into first refiner 40. The starting fibers have diameter of a few microns with fiber length varying from about 2-6 mm. The fiber concentration in water can vary from 1-6% by weight. The first refiner is fed continuously with fibers 22 and, after open channel refining therein for a desired time, the processed fiber suspension 34 continuously flows to succeeding refiner 50, where it is further open channel refined at a higher shear rate. The processed fiber suspension 36 then flows from refiner 50 to refiner 60, and then as processed fiber suspension 38 to refiner 70, where it is further open channel refined at increasing shear rates in continuous mode operation. The finished fibrillated fiber suspension 80 emerges from refiner 70.

The rate at which the fibers are fed into first refiner 40 is governed by the specifications of the final fibrillated fiber 80. The feed rate (in dry fibers) can typically vary from about 20-1000 lbs./hr. (9-450 kg/hr), and the average residence time in each refiner varies from about 30 min. to 2 hours. The number of sequential refiners to meet such production rates can vary from 2 up to 10, with each refiner having a shear rate higher than that of the previous refiner. The temperature inside the refiners is usually maintained below about 175° F. (80° C.).

Figure 4:
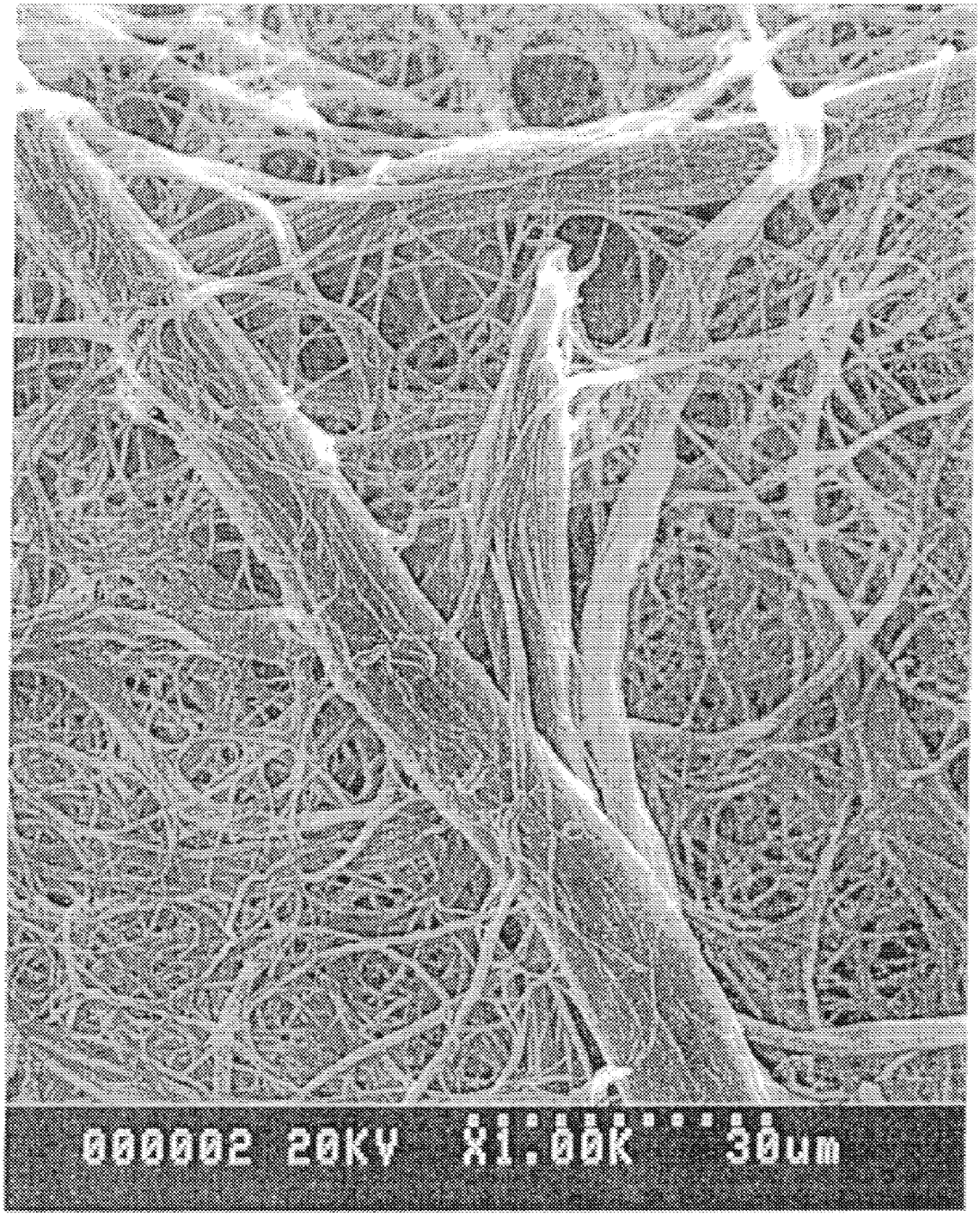
FIG. 4 is a photomicrograph of a fiber with nanofiber-sized fibrils made in accordance with the present invention.

The processed fiber 80 is characterized by Canadian Standard Freeness rating of the fiber mixture, and by optical measurement techniques. Typically, entering fibers have a CSF rating of about 750 to 700, which then decreases with each stage of refining to a final CSF rating of about 50 to 0. The finished fibrillated fiber product obtained at the end of processing has all the nanofibers still attached to the core fibers, as shown in FIG. 4.

Example of Continuous Processing

Fiber slurry of 3.5% solids content is fed into the first of a series of open channel refiners at 33 gal./min. (125 l/min.). The fiber length varies between 2 to 5 millimeters. The processed fiber from the first open channel refiner is fed into the second open channel refiner and optionally into one or more other open channel refiners until the desired CSF is achieved in the last open channel refiner. For the first open channel refiner, there are three blades, each 17 in. (43 cm) in diameter running at a speed of about 1750 rev./min. The intermediate open channel refiners have four 20 in. (51 cm) diameter blades running at a speed of about 1750 rev./min. The last open channel refiner has two 23 in. (58 cm) blades running at a speed of about 1750 rev./min. The fiber in every open channel refiner represents a range of CSF curve from CSF 700 to CSF 0. The fiber in the first open channel refiner has an average CSF distribution close to CSF 700 and the fiber in the last open channel refiner has an average CSF distribution close to CSF 0. At any given point during the process, every open channel refiner contains about 600 lbs. (275 kg) of dry fiber and 2000 gal. (7570 l) of water. The consistency of each open channel refiner is kept around 3.5 weight percent solids.

As an alternative to continuous processing, the present method of producing fibrillated fibers may be run as a batch process as well. In batch mode, each individual refiner may be used to produce about 3-700 lbs/hr (1.5-320 kg/hr). The residence time in each refiner varies from about 30 min. to 8 hours. The blade dimensions are optimized for appropriate shear rate, which may be determined without undue experimentation. The material produced in batch and continuous mode is identical, as characterized using CSF and optical measurement techniques, and the rheological properties are not affected.

If further refining is required, the fiber suspension may be recycled 32 from the final refiner back to any previous refiner stage 24, 26, 28 or 30 for additional open channel refining. The resulting fiber suspension, after all open channel refining, may proceeds to belt dewatering to provide the final wet lap fibrillated fibers. Such fibrillated fibers may be used for papermaking, filters, or other uses typical of such fibers. Alternatively, the suspension may undergo further processing, as set forth in U.S. patent application Ser. No. 11/694,087 entitled "Process for Producing Nanofibers" by the same inventors filed on even date herewith.

Thus, the present invention provides an improved process and system for producing fibrillated fibers, with fibrils in the nanofiber-size range attached to larger core fibers, that is more efficient than prior methods in time and cost. The process retains elongated fiber length with reduced amount of fines at higher energy efficiency and productivity, resulting in improved volume and yield.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A process for making fibrillated fibers comprising:

preparing a fluid suspension of fibers;

low shear refining the fibers at a first shear rate to create fibrillated fibers having a reduced CSF; and subsequently higher shear refining the fibers at a second shear rate, higher than the first shear rate, to increase the degree of fibrillation of the fibers.

2. The process of claim 1 wherein the refining at the first shear rate is with a rotor at a first maximum shear rate and the refining at the second shear rate is with a rotor at a second maximum shear rate, higher than the first maximum shear rate.

3. The process of claim 2 further including removing from the fiber suspension heat generated by motion of the rotor during the open channel shearing.

4. The process of claim 1 further including pre-treating the fibers by high shear refining with impact to stress the fibers prior to low shear refining.

5. The process of claim 4 wherein the fiber suspension flows continuously and in series from the initial high shear refining to and through the subsequent low and higher shear refining, and further including controlling the rate of flow of the fiber suspension through at least some portions of the process to decrease or increase the degree of fibrillation of the fibers.

6. The process of claim 1 wherein the refining of the fibers is with a first rotor operating at a first angular velocity and subsequently with a second rotor operating at a second angular velocity, higher than the first angular velocity.

7. The process of claim 1 wherein the refining of the fibers is with a first rotor having a first diameter and subsequently with a second rotor operating having second diameter, higher than the first diameter.

8. The process of claim 6 wherein the fiber suspension flows continuously from the first rotor operating at the first maximum shear rate to the second rotor operating at the second maximum shear rate.

9. The process of claim 8 further including controlling the rate of flow of the fiber suspension, wherein reducing the flow rate extends the time the suspension is processed by each rotor and increases degree of fibrillation of the fibers, and increasing the flow rate reduces the time the suspension is processed by each rotor and decreases degree of fibrillation of the fibers.

10. The process of claim 1 further including refining the fibers at a third shear rate, higher than the second shear rate, to further increase the degree of fibrillation of the fibers.

11. The process of claim 1 further including refining the fibers at more than three shear rates, with each shear rate being higher than the previous shear rate, to further increase the degree of fibrillation of the fibers.

12. A process for making fibrillated fibers comprising:

preparing a fluid suspension of fibers;

low shear refining the fibers with a rotor at a first shear rate to create fibrillated fibers having a reduced CSF; and subsequently higher shear refining the fibers with a rotor at a second shear rate, higher than the first shear rate, to increase the degree of fibrillation of the fibers.

13. The process of claim 12 further including pre-treating the fibers by high shear refining with impact to stress the fibers prior to low shear refining.

14. The process of claim 13 wherein the fiber suspension flows continuously and in series from the initial high shear refining to and through the subsequent low and higher shear refining, and further including controlling the rate of flow of the fiber suspension through at least some portions of the process to decrease or increase the degree of fibrillation of the fibers.

15. The process of claim 12 wherein the refining of the fibers is with a first rotor operating at a first angular velocity and subsequently with a second rotor operating at a second angular velocity, higher than the first angular velocity.

16. The process of claim 15 wherein the fiber suspension flows continuously from the first rotor operating to the second rotor.

17. The process of claim 12 wherein the refining of the fibers is with a first rotor having a first diameter and subsequently with a second rotor operating having second diameter, higher than the first diameter.

18. The process of claim 17 wherein the fiber suspension flows continuously from the first rotor operating to the second rotor.

19. The process of claim 12 further including controlling the rate of flow of the fiber suspension, wherein reducing the flow rate extends the time the suspension is processed by each rotor and increases degree of fibrillation of the fibers, and increasing the flow rate reduces the time the suspension is processed by each rotor and decreases degree of fibrillation of the fibers.

20. The process of claim 12 further including removing from the fiber suspension heat generated by motion of the rotor during the open channel shearing.

21. The process of claim 12 further including refining the fibers at a third shear rate, higher than the second shear rate, to further increase the degree of fibrillation of the fibers.

22. The process of claim 12 further including refining the fibers at more than three shear rates, with each shear rate being higher than the previous shear rate, to further increase the degree of fibrillation of the fibers.

* * * * *

UNITED STATES PATENT AND TRADEMARK OFFICE

CERTIFICATE OF CORRECTION

PATENT NO. : 7,566,014 B2
APPLICATION NO. : 11/694070
DATED : July 28, 2009
INVENTOR(S) : Koslow et al.

It is certified that error appears in the above-identified patent and that said Letters Patent is hereby corrected as shown below:

In the Specification:

Col. 1, line 38, after "skilled in" insert -- the --

Col. 1, line 53, after "shear refining" insert -- . --

Col. 3, line 46, delete "from a tow" and substitute therefore -- from a low --

Col. 4, line 51, delete "is drive down" and substitute therefore -- is driven down --

Col. 6, line 30, delete "proceeds" and substitute therefore -- proceed --

Signed and Sealed this

Fifteenth Day of December, 2009

David J. Kappos

David J. Kappos
*Director of the United States Patent and Trademark Office*